United States Patent [19]

Ophey

[11] 4,252,432

[45] Feb. 24, 1981

[54] CONTROL SYSTEM FOR ELECTROPHOTOGRAPHIC APPARATUS

[75] Inventor: Petrus J. M. Ophey, Grubbenvorst, Netherlands

[73] Assignee: Océ-van der Grinten N.V., Venlo, Netherlands

[21] Appl. No.: 22,925

[22] Filed: Mar. 22, 1979

[30] Foreign Application Priority Data

Mar. 30, 1978 [NL] Netherlands ..... 7803354

[51] Int. Cl.[3] ..... G03G 15/00

[52] U.S. Cl. ..... 355/14 R; 355/16

[58] Field of Search ..... 355/3 R, 3 BE, 14 R, 355/16

[56] References Cited

U.S. PATENT DOCUMENTS 3,912,390 10/1975 van Herten ..... 355/14 R 4,082,443 4/1978 Draugelis et al. ..... 355/14 R X 4,110,033 8/1978 Ophey ..... 355/14 R

*Primary Examiner*—Fred L. Braun

*Attorney, Agent, or Firm*—Albert C. Johnston

[57] ABSTRACT

For control of an indirect electrophotographic copier employing an endless photoconductive belt having thereon at least one marking which excites a sensor each time the marking passes a fixed point in the belt path, the movement of the belt is measured electronically by a pulse generator coupled to a belt transport roller and a counter. Any difference between an electronically registered length of the belt and its actual length at a moment of sensor excitation is registered in a memory. At the end of a copying run pulses from the generator are diverted to the memory which then causes the difference to be corrected by discontinuation of the driving of the belt at an earlier or later moment.

3 Claims, 2 Drawing Figures

CONTROL SYSTEM FOR ELECTROPHOTOGRAPHIC APPARATUS

Figure 1:
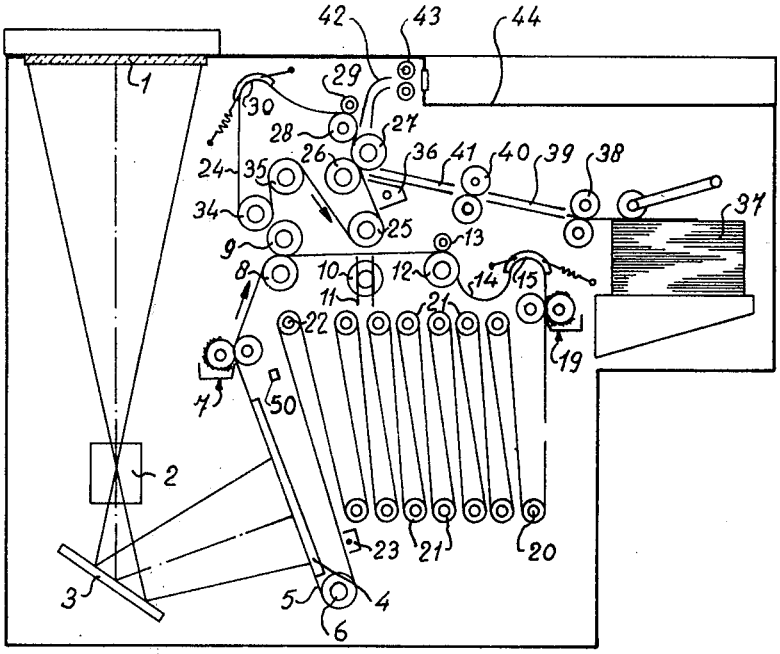
Fig. 1 PRIOR ART

This invention relates to a process and apparatus for making a copy of an original by forming an image electrophotographically on a moving endless photoconductive belt and transferring the image to a receiving material. The invention relates more particulary to a control system of the kind in which the location for an image formation on the photoconductive belt is determined with the aid of a marking thereon, which excites a sensor installed at a fixed location along the belt transport track, and of at least one counter which counts signal pulses generated by a pulse generator at a frequency proportional to the transport speed of the belt, thus controlling the switching on and off of the electrophotographic functions according to the number of pulses counted.

Control systems of the kind mentioned are disclosed in U.S. Pat. Nos. 3,912,390 and 4,110,033. In these known systems the images are formed at so-called fixed imaging locations, which are employed on the one hand to compensate for slipping of the belt relative to the driving of the pulse generator and, on the other hand, to correct for deviations of the actual length of the belt from its nominal length.

According to U.S. Pat. No. 3,912,390 each location for image formation is provided with a marking which is detected by the sensor in order that the image formations can always take place at the same places on the belt upon repeated movement of the belt through the electrophotographic processing stations. This, however, has a disadvantage in that a marking must be applied on the photoconductive belt for every location which it provides for image formation, thus involving extra processing. While slipping is corrected for each imaging location, variations in the length of the belt are distributed into small variations of the belt length per imaging location.

According to U.S. Pat. No. 4,110,033 only one principal marking needs be applied on the photoconductive belt. Two control circuits are employed which are substantially identical and are used alternately during one complete run (revolution) of the belt, in such manner that a switching-over from one circuit to the other takes place at the moment when the marking excites the sensor. In this way the copying process can be carried out with the image formations occurring at fixed locations without requiring the length of the belt to be exactly equal to a whole number multiple of the number of imaging locations. On the other hand, although corrections are made for both slipping and length differences with each revolution of the belt, the system has the disadvantage of requiring duplication of a major part of the control circuit.

The principal object of the present invention is to provide a control system of the kind first above mentioned with relatively simple means whereby correction will be effected for any slipping or dimensional change of the photoconductive belt relative to the pulse generator.

According to the invention, it has been found that this object can be achieved by a system in which, at the moment when a marking on the belt excites the sensor, the differences between a predetermined number of pulses and the number of pulses counted up to that moment by the counting means is registered in a memory element, and at the end of a copying run then being executed, to enable stopping of the belt at an earlier or later moment for correction of its position, the supply of pulses from the pulse generator to the counting means is interrupted and these pulses are supplied to the memory element until the number of pulses so supplied is equal to the difference registered in the memory element. The driving of the belt is continued during this diversion of pulses, to correct the position of the belt relative to the sensor.

Figure 2:
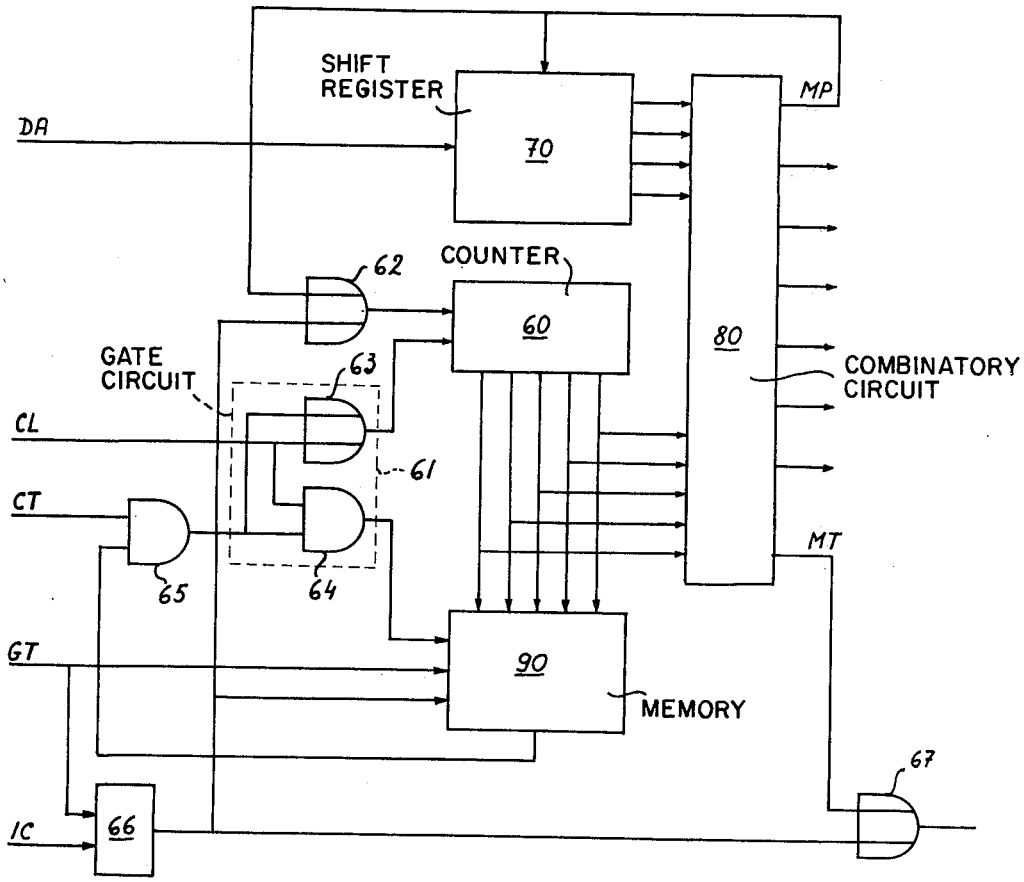

This characteristic and other features and advantages of the invention will become apparent from the following description of a preferred, illustrative embodiment thereof. Reference is made in the description to the accompanying drawings in which:

FIG. 1 is a schematic sectional view of an electrophotographic copying apparatus in which the invention can be employed, and FIG. 2 is a diagram of a control circuit for carrying out the invention in the use of such an apparatus.

In the apparatus illustrated by FIG. 1, a continuously moving endless belt 5 comprising a photoconductive layer fixed on an electrically conductive layer is charged uniformly by a corona device 23 and then is transported over a roller 6 and past a suction box 4 which keeps the belt held flat against the box while an electrostatic charge image is formed on the belt by imagewise discharging it. The imagewise discharging is effected by projecting onto the belt 5, via a lens 2 and a mirror 3, the reflected light image of an original lying on an exposure plate 1. The original is exposed by flash lamps (not shown). The flash exposure makes it possible to keep the belt moving continuously while the original is stationary.

The belt portion on which the latent electrostatic charge image has been thus formed subsequently moves through a developing station 7, where the latent image is converted into a powder image. The belt then passes over a continuously rotated driving roller 8, which may be provided with a counter pressure roller 9, and the outer surface of which has a high coefficient of friction relative to the belt, thus driving the belt 5 continuously. From the roller 8 the belt runs over a roller 10 which is movable along a guide 11 toward and away from the belt, so up and down as seen in FIG. 1, in order to press the belt when so desired against an image receiving belt 24 that is guided about a roller 25, in such manner that the powder image on belt 5 will be transferred to and held on the belt 24. Such an image transfer system is described in U.S. Pat. No. 4,068,937. The belt 5 subsequently moves over a roller 12, which may be provided with a counter-pressure roller 13, and then hangs down into a loop 14 leading to and over a static curved surface 15 which serves for aligning the belt, as described more particularly in U.S. Pat. No. 3,846,021. Then the belt 5 moves through a cleaning device 19 for removing residual powder, as generally known, and then it is guided about a roller 20 to and over a number of reversing rollers 21 which together form a magazine for accummulating a major portion of the length of the belt. From this magazine the belt is transported over a roller 22 and then again past the corona device 23 to the roller 6 ahead of the exposure station.

The image receiving belt 24 is driven by roller 25, from which it is guided between roller pairs 26, 27 and 28, 29 to a static curved surface 30 which serves, similarly as surface 15, for aligning a lead of the belt 24 that hangs down freely between the rollers 28, 29 and surface 30. From surface 30 the belt 24 runs over a reversing roller 34, thence over a roller 35, and from roller 35 back to the driving roller 25.

A radiant heating device is indicated at 36, by which heat is applied to the powder image taken over onto belt 24 from belt 5 at the location of the rollers 10 and 25, thus making this powder image sticky so that it can easily be transferred from belt 24 to copy paper. Sheets of copy paper are supplied successively from pile 37 via rollers 38, guide 39, rollers 40 and guide 41 to the nip between belt 24 and roller 27. Each sheet passed through that nip is transported through guide 42 to rollers 43 which lay the copy sheet down on a delivery table 44.

In the illustrated embodiment, typically, the photoconductive belt 5 is formed by a finite length of belt that is made endless by a seam joining its ends together. At the location of the seam the belt is provided with a marking which is detectable by a sensor 50 so that the sensor 50 will generate a signal pulse, denoted GT in FIG. 2, for use as one of the input signals of the control circuit to be described below. Such a marking can be formed, for instance, by a perforation, or by a small square that has a light-reflecting property contrasting with that of the belt. According to the invention, however, the photoconductive belt used can also be a seamless endless belt provided with a marking at any location suitable for activating the sensor.

The belt driving roller 8 is coupled with a so-called pulse disc which forms part of a pulse generator, such for example as that described more particularly in U.S. Pat. No. 3,912,390. This pulse generator will generate signal pulses, denoted CL in FIG. 2, with a frequency porportional to the speed of movement of the belt 5, which signal pulses CL are also used as an external input signal for the control circuit still to be described.

A third input signal for the control circuit, denoted as signal DA in FIG. 2, is generated by a so-called copy selector which generates an output signal as long as still at least one copy of an original is to be made in a run of the copying apparatus. Such a selector typically comprises a selecting mechanism by which the operator of the apparatus can set the number of copies to be made of a same original in a run and an electric circuit that compares the set number of copies with the number of copies already made in the run.

The control circuit for the apparatus of FIG. 1, as represented in FIG. 2, is composed principally of a counter 60, a shift register 70 and a combinatory circuit 80 in which the respective output signals of the counter 60 and the shift register 70 are combined. The principal functions and operations of this control circuit correspond to those of the control circuit described in U.S. Pat. No. 3,912,390.

The count input of the counter 60 is connected via gate 63 of a gate circuit 61 with the generator of the signal pulses CL. The reset input of the counter 60 is connected via an OR-gate 62 with an output of the combinatory circuit 80, in which output a signal pulse MP is generated on every occasion when, irrespective of the signals present in the outputs of the shift register 70, a signal combination present in the outputs of counter 60 corresponds to a predetermined number, for instance the number 360.

The shift register 70 has an input connected with the same output of the combinatory circuit in which the signal MP is generated, whereas the data input of the shift register 70 is connected with the output of the copy selector in which the signal DA is generated.

According to the present invention, the outputs of the counter 60 are also connected with a memory element 90 which has an activating input connected with the output of the sensor 50 (signal GT). Since a signal pulse GT is generated in the output of the sensor 50 at the moment when the marking on the photoconductive belt passes the sensor 50, the memory element 90 is then activated and it takes over and stores the number which is present in the counter 60 at that moment.

The memory element 90 also has a count-down input which is connected with the output of a second gate 64 of the gate circuit 61. This count-down connection causes the stored number present in the memory element 90 to be diminished by one unit each time a signal pulse is generated in the countdown input.

The gate circuit 61 consists of an OR-gate 63 having two inputs and an AND-gate 64 having two inputs. The output of the gate 63 is connected with the count input of the counter 60, and the output of the gate 64 is connected with the count-down input of the memory element 90.

One input of the OR-gate 63 and one input of the AND-gate 64 are connected with the output of the pulse generator in which the signal CL is generated. The other inputs of the OR-gate 63 and AND-gate 64 are connected with the output of an AND-gate 65 having two inputs. The first input of the AND-gate 65 is connected with an output of the combinatory circuit 80 in which a signal CT is generated. The signal CT exists when a copying run has almost been finished; for instance, it is generated at the moment when the signals in the first four outputs of the shift register are zero. The second input of the gate 65 is connected with an output of the memory element 90, in which output a signal is present as long as a number different from zero is stored in the element 90.

A third input of the memory element 90 is connected with the output of a flipflop 66. As long as a signal is present in this third input, the memory element 90 is reset; in other words, the number present in the memory element is reset and kept to zero. The flipflop 66 has a set input connected with the main switch of the copying apparatus, so that the flipflop is set when the copying apparatus is switched on. The reset input of the flipflop 66 is connected with the output of the sensor 50, thus receiving the signal pulse GT when the marking on the belt activates the sensor.

The output of the flipflop 66 is also connected with an input of an OR-gate 67 having two inputs, of which gate the output is connected with an activating circuit for the drive of the photoconductive belt 5 so that the belt 5 is driven as long as the gate 67 has a high output signal. The second input of the OR-gate 67 is connected with an output of the combinatory circuit 80, in which a signal is generated as long as a copying run is going on, for instance as long as in at least one of the first four outputs of the shift register 70 a signal is present or the counter 60 contains a number smaller than 300.

The operation of the described control system is as follows:

When the copying apparatus is switched on, for instance by operating the main switch, the signal IC is generated and it sets the flipflop 66. The output signal of the flipflop 66 then resets the counter 60 via gate 62, also resetting the memory element 90 and keeping the counter and the memory element in reset condition. At the same time, the drive of the photoconductive belt 5 is activated via the gate 67, thus causing clock pulses CL to be generated. These pulses are supplied to the counter 60, but this at first has no further consequences because the counter is being kept reset by the output signal of the flipflop 66.

A signal GT is generated at the moment when the marking on the photoconductive belt 5 arrives at the position of the sensor 50. This signal resets the flipflop 66, and consequently the driving of the belt is stopped with the photoconductive belt 5 disposed in a known, registered position relative to the electrophotographic processing stations of the apparatus. Also, the elements 60 and 90 are reset, so that the apparatus is ready for copying.

A copying run is started by pressing the print button of the apparatus, and is controlled via the signals DA and CL and the elements 60, 70 and 80. The principal operations take place substantially as described in the above noted U.S. Pat. Nos. 3,912,390 and 4,110,033.

During the transport of the photoconductive belt 5 through the apparatus this belt is likely to undergo a certain slipping relative to the driving roller 8 to which the pulse generator is connected. Such slipping causes the position of the belt 5 to start deviating from the desired registered position. Any such deviation is now corrected as described below.

At the moment during a copying run when the marking on the photoconductive belt 5 passes the sensor 50, the signal GT then generated causes the then existing condition of the counter 60 to be introduced into the memory element 90. Assuming, as typically is the case, that the exact length of the photoconductive belt is a whole number multiple of the belt length corresponding to 360 signal pulses CL, the counter would normally have to be in the zero position at the moment when signal GT is generated; so if a number is stored in the memory element 90 by transfer from the counter 60, this number will in fact correspond to a deviation of the actual belt position from the registered position established at the start of the run.

Such a deviation will occur in almost all cases, as it is practically impossible to prevent all slipping and all variations of the length of the belt. The deviation may be either positive or negative, thus indicating that the counter has counted more or less pulses, respectively, than the number of pulses properly corresponding to the distance over which the belt has in fact been transported. In the case of a positive deviation, the belt needs to be further transported over the corresponding distance, whereas in the case of a negative deviation the belt needs to be returned over the corresponding distance. In practice, however, the belt consists of a whole number of imaging locations each of which has a length corresponding to a certain number of pulses generated by the pulse generator, for instance 360 pulses. Consequently the correction of a negative deviation can be effected by further transporting the belt over a distance corresponding to 360 pulses minus the number of pulses counted as too few. This is the number which is also stored in the memory element 90 via the signal GT.

The copying run is normally continued while the deviation of the actual position of the photoconductive belt from the desired predetermined position is registered in the way described above. Then at the end of this copying run, i.e., after the last copy has been made and for instance while this copy is still being ejected, but while the photoconductive belt is still being driven, a signal CT is generated by the combinatory circuit. This signal exists for instance when the first four outputs of the shift register 70 are zero and counter 60 contains the number zero.

The signal CT acts via the gate 65 and gate circuit 61 to block the supply of counting pulses CL to the counter 60, and causes these pulses now to be supplied via the count-down input to the memory element 90 until the number stored in this element has been brought to zero. Then the gate 65 is blocked by the zero output from the memory element 90 and the counting pulses are again supplied to the counter 60. During this short diversion of the counting pulses the photoconductive belt is further transported over a distance corresponding to the number stored in the memory element 90, but without changing the condition of the counter 60.

After this position correcting transport has taken place, the photoconductive belt is still further transported until a certain pre-selected number is reached in the counter, at which point the signal MT disappears and the apparatus is ready for starting a new copying run.

What is claimed is:

1. In a control system for a copying apparatus comprising electrophotographic means for forming an image of an original to be copied on a moving endless photoconductive belt and means for transferring the image from said belt to a receiving material, said system including a marking on the photoconductive belt, a sensor excitable by said marking at a fixed point in the path of transport of the belt, a pulse generator which generates signal pulses at a frequency proportional to the transport speed of the belt, means comprising at least one counter for counting said pulses, and means controlled in response to numbers of said pulses counted by said counting means for switching on and off said electrophotographic means, the improvement wherein said system further includes a memory element connected with said counting means, means operative in a copying run of the apparatus at the moment when said marking excites said sensor for registering in said memory element the difference between a predetermined number and the number of pulses which at that moment is counted in said counting means, and means operative at the end of the copying run then being executed for diverting from said counting means to said memory element pulses generated by said pulse generator until the memory element is supplied with a number of said pulses corresponding to said difference registered therein.

2. A control systtem according to claim 1 for copying apparatus as aforesaid provided with means for driving said belt and with a switch for activating and inactivating said driving means, further including means operative when said driving means is first activated by said switch for inactivating said driving means at the moment when a marking on the photoconductive belt excites said sensor.

3. A control system according to claim 1 or 2 and wherein said counting means comprises a counter which counts the pulses generated by said pulse generator and is reset upon reaching a predetermined count number and a shift register which thereupon is shifted onwards by one step, said means for registering said difference in said memory element including means whereby, at the moment in a copying run when said sensor is excited by said marking, the count condition of said counter is taken over into and stored by said memory element.

* * * * *